US005522646A

United States Patent [19]

Friedman et al.

[11] Patent Number: 5,522,646

[45] Date of Patent: Jun. 4, 1996

[54] APPARATUS FOR CUTTING FREE MANHOLE CASINGS IN COATINGS

[75] Inventors: Gershon Friedman, Langnau, Switzerland; Bo R. Zaccho, Skanderborg, Denmark

[73] Assignee: Bo Ravnbaek Zaccho, Skanderborg, Denmark

[21] Appl. No.: 404,276

[22] Filed: Mar. 14, 1995

Related U.S. Application Data

[63] Continuation-in-part of PCT/DK93/00294, Sep. 14, 1993 published as WO94/06966, Mar. 31, 1994.

[30] Foreign Application Priority Data

Sep. 14, 1992 [DK] Denmark ..... 1127/92

[51] Int. Cl.[6] ..... E01C 23/09

[52] U.S. Cl. ..... 299/39.3; 299/39.5

[58] Field of Search ..... 299/39, 41, 90, 299/39.3, 39.5, 39.6; 404/90, 72

[56] References Cited

U.S. PATENT DOCUMENTS 4,458,949 7/1984 Jury ..... 299/41
4,924,951 5/1990 Paulson ..... 175/57

FOREIGN PATENT DOCUMENTS 0367951 11/1988 European Pat. Off. .
3319586 5/1983 Germany .

*Primary Examiner*—David J. Bagnell
*Attorney, Agent, or Firm*—Antonelli, Terry, Stout & Kraus

[57] ABSTRACT

An apparatus (2) for cutting free cover well curb in coating (4), for instance asphalt coating (10), comprising of a basis part (16) pivotally fastened around a vertical center axis in proportion to a support plate (4), which is adapted to be placed centered on a cover (6), a—in proportion to the basis part (16) and said center axis—radial adjustably fastened bracket part (18), a—in proportion to the bracket part—level adjustably fastened support bracket (26) for a rotating cutting or mill unit (42), preferably driven by a internal combustion engine (38), and a turning motor (54) inserted between the basis part and the support plate. Hereby an apparatus is obtained, which by simple provisions is able to automatically to cut free a cover well curb. The apparatus is just placed in the middle of the cover, whereafter the driving motor preferably in the shape of a combustion engine is started. By means of a turning motor the quick-rotating cutting or mill blade is turned round along the edge of the cover well curb, while the cutting or mill unit slowly is moved downwards, until the well curb is cut free from the coating.

7 Claims, 1 Drawing Sheet

APPARATUS FOR CUTTING FREE MANHOLE CASINGS IN COATINGS

CROSS-REFERENCE TO RELATED APPLICATIONS

This application is a continuation-in-part application filed under 35 USC §111 and 37 CFR §1.53, pursuant to 35 USC 365(c), of International Application Ser. No. PCT/DK93/00294, filed Sep. 14, 1993, designating the United States of America, and based upon Danish Application 1127/92, filed Sep. 14, 1992, and corresponding to WO 94/01800.

The present invention relates to an apparatus for cutting free manhole casings in a coating, for instance an asphalt coating.

DESCRIPTION OF THE PRIOR ART

For replacement and/or level adjustment of covers, for instance manhole covers for sewer, district heating or the like, settled in concrete or asphalt coatings, a relative large and time-consuming amount of manual work for cutting free the cover and/or manhole casing from the asphalt coating is normally required, which usually is done by means of pneumatic tools.

DE-A1-33 19 586 discloses a milling device for providing a groove around a manhole casing which device comprises an anchoring or a centering part adapted to be clamped in an open manhole casing. Furthermore this device comprises a projecting support beam which at a distance from the milling device is wheel supported on the ground, as the milling device is adapted to be manually rotated around the open manhole casing for milling a grove around the manhole.

SUMMARY OF THE INVENTION

The invention has for its purpose to provide an apparatus for cutting free manhole casings in a coating, for instance an asphalt coating by which the cutting free of the manhole casing in a simple manner may be carried out quickly and precisely without a large amount of manual work.

The apparatus according to the invention is distinctive in that it comprises a support plate to be placed centered above or on a manhole cover, a radially adjustably arranged bracket part relative to a base part, a height displacably arranged support bracket relative to the base part for a rotating cutting unit driven by an internal combustion engine, and a turning motor inserted between a base part and the support plate.

The invention by simple provisions is able automatically to cut free a manhole casing. The apparatus is just placed in the middle of the cover, whereafter the driving motor preferably, an internal combustion engine is started. A turning motor, receiving power from the internal combustion engine, drives a quick-rotating cutting or milling blade which is turned round along the edge of the manhole casing, while the cutting unit slowly is moved downwards, until the manhole casing is cut free from the coating.

The turning motor consists of an electric motor driven by a generator, which is driven by the internal combustion engine, and which via an electrical control system also is connected with a battery.

Preferably the level adjustment of the cutting or milling unit according to the invention is provided with a support bracket arranged on vertical guiding rod members of a bracket part, and hydraulic support cylinders are inserted between the bracket part and the support bracket, which cylinders receive hydraulic liquid from a liquid tank via a hand pump. An adjustment valve controls descending of the cutting unit which is inserted between the support cylinders and the liquid tank.

The turning mechanism is simple, robust manner and is provided that the support plate around a central bearing housing comprising a rim or gear wheel drive-connected with the turning motor via a driving wheel in form of a pinion, with the rim or gear wheel and pinion being driven by a roller chain.

To secure optimum cutting free of the cover well curb the apparatus according to the invention has the blade of the cutting unit slightly inclined downwards and inwards with reference to the vertical center axis.

To secure good contact between cover and support plate the apparatus has the support plate on its underside provided with downward projecting grasping members for engaging into recesses of a figured top side of the cover.

For use for instance on an asphalt or concrete coating, the apparatus according to the invention may have the support plate on its underside provided with a friction coating, prevent rotation of the support plate when placed on a smooth surface.

BRIEF DESCRIPTION OF THE INVENTION

The invention is further explained in the following with the drawing, in which.

DESCRIPTION OF THE PREFERRED EMBODIMENTS

Figure 1:
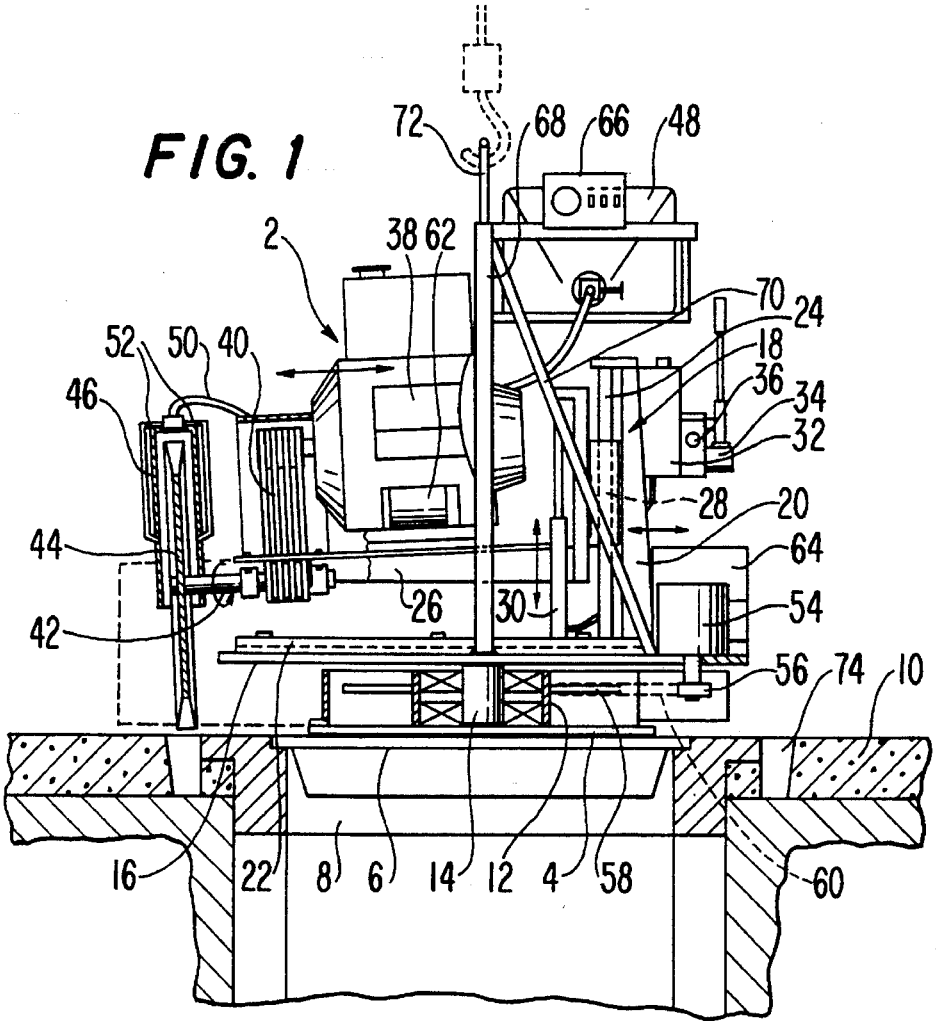
FIG. 1 shows a side view, partly in section, of an embodiment for an apparatus according to the invention.

The cover cutting apparatus shown in FIG. 1 comprises a support plate 4 intended to be placed centered on a cover 6, which is placed in a manhole casing 8 being anchored in an asphalt coating 10. The support plate 4 is on the top side provided with a bearing housing 12 for a central bearing pivot 14 of a base part 16.

A bracket part 18 with a vertical part 20, is fastened radially moveable at the top side of the base part 16 between guide rails 22 consisting of angle iron, and which may squeeze the bracket part 18 into the wanted position towards the top side of the base part 16. The vertical part 20 comprises guiding rod members 24, on which a support bracket 26 is level adjustably fastened by gliding rod members 28. Between the bracket part 18 and upper parts of the support bracket 26, hydraulic support cylinders 30 are inserted, which are connected with a hydraulic liquid tank 32 via a hand pump 34, so that the support bracket 26, by means of the hand pump 34, may be lifted upwards upon supplying of hydraulic liquid to the support cylinders 30. Subsequently the support bracket 26 may be moved downwards by restoring of hydraulic liquid to the tank 32 via an adjustment valve 36, so that the support bracket 26 may descend rather slowly relative to the base part 16.

At the support bracket 26 an internal combustion engine 38 is mounted, which via a V-belt drive 40 is drive connected with a cutting unit 42 with a cutting or milling blade 44, which relative to the vertical centre axis of the apparatus is slightly inclined downwards and inwards.

The cutting blade 44 is partly surrounded by a cover 46 by which cooling water may be supplied to both sides of the blades 44 from a water container via a supply pipe 50 and a ramification 52. The base part 16 is provided with an electrical turning motor 54, which via a pinion 56 is connected with a rim or gear wheel 58 fastened outside the bearing housing 12 by means of a roller chain 60, which engages the rime of gear wheel 58 and driving wheel 56.

The electrical turning motor 54 is provided with electricity from a generator 62 driven directly from the internal combustion engine 38, and which via a electrical control system also is connected with a battery 64, which also may deliver starting current to an electrical starting motor for the internal combustion engine 38. The electrical control system of the apparatus furthermore comprises a control board 66, on which the rotational speed of the turning motor 54 among others may be adjusted.

The cover cutting apparatus 2 comprises a pivoting support 68 extending from the base part 16 provided with an inclined brace 70, and which at the top is provided with lifting eye 72 for use by a crane handling the apparatus.

The cover cutting apparatus according to the invention is operating in the following manner:

As shown in FIG. 1 the cover cutting apparatus 2 is for instance placed by means of a truck crane centered on the cover 4 with the cutting unit 42 in the shown position. The combustion engine 38 is started preferably via the control board 66 by an electrical starting motor. The adjustment valve 36 is so adjusted that circulation of the hydraulic liquid from the support cylinders 30 will take about 4 minutes, that is so that the descending speed of the support bracket 26 is pre-adjusted correspondingly. The turning motor 54 is started and its rotational speed is adjusted on the control board 66 to for instance about 10 revolutions per minute.

Figure 2:
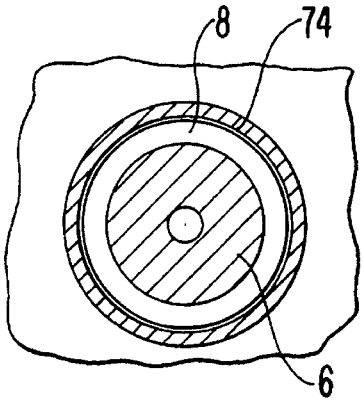
FIG. 2 shows how a circular manhole casing may be cut free by means of the apparatus according to the invention.

Hereafter, the rotating cutting blade 44 while the base part 16 slowly is rotating around the support plate 4 makes a groove (FIG. 2) in the asphalt coating around the manhole casing 8 to loose the casing from the asphalt coating 10, so that the manhole casing may be easily taken up, be changed or be replaced at a new correct level. These described operations are the operations most often performed in connection with renewal of the asphalt coating 10.

Figure 3:
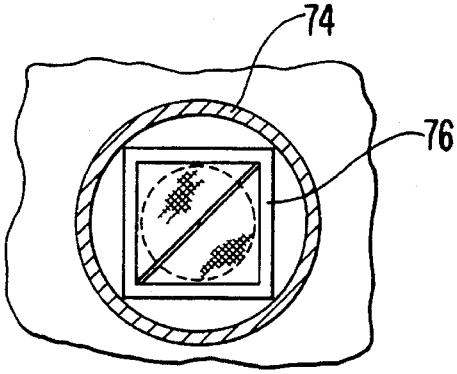
FIG. 3 shows, that the apparatus according to the invention also may be used for cutting free of rectangular manhole casings.

As shown in FIG. 3 the cover cutting apparatus 2 naturally also may be used for cutting free a rectangular manhole casing 76, which subsequently may be replaced by circular manhole casing fitting the cut out.

With a suitable choice of cutting blade the apparatus according to the invention may be used more generally for making circular cut outs in other types of coatings, such as concrete or flagstone coatings. In principle it is possible to use the same principle to make circular cutting outs in horizontal divisions in buildings- or even in steel decks.

Finally the support plate of the cutting apparatus may have the same dimension as that of the cover so that the support plate of the cutting apparatus is placed directly in the manhole casing opening.

We claim:

1. An apparatus for cutting free a manhole from a coating comprising:

a support plate for placement on top of the coating above the manhole;

a base rotatably mounted relative to the support and rotatably about a vertically extending center axis projecting upward from the base;

a rotating cutting unit driven by an internal combustion engine which rotates a cutting wheel for cutting free the manhole;

a radially adjustable bracket, coupled to the rotating cutting unit, which is radially moveable relative to the base and the vertically extending center to vary a cutting radius of the cutting wheel relative to the vertically extending center axis;

a support, attached to the rotating cutting unit and coupled to the radially adjustable bracket, which is vertically adjustable to vary a depth of cutting of the cutting wheel; and a turning motor, coupled to base and to the vertically extending center axis, for rotating the base to cause the rotating cutting unit to rotate around the vertically extending center axis.

2. An apparatus in accordance with claim 1 wherein:

the turning motor comprises an electric motor driven by an electrical power generator which is driven by the internal combustion engine; and further comprising an electrical control system for controlling the turning motor; and a battery, coupled electrically to the electrical control system and to the generator.

3. An apparatus in accordance with claim 1 wherein:

the support is mounted on vertical guiding rod members attached to the radially adjustable bracket;

at least one hydraulic support cylinder coupled to the radially adjustable bracket and to the base to vary a vertical position of the support relative to the base;

a liquid tank for storing hydraulic fluid and in fluid communication with the at least one hydraulic support cylinder; and a pump for pumping hydraulic fluid from the tank to the hydraulic cylinder to raise the cutting unit.

4. An apparatus in accordance with claim 3 further comprising:

a regulator valve in fluid communication with the support cylinder and the liquid tank to control a rate of flow of hydraulic fluid from the at least one hydraulic cylinder to the tank to control a rate of descending of the rotating cutting unit.

5. An apparatus in accordance with claim 1 further comprising:

a bearing housing containing a bearing rotatably supporting rotation of the base with the bearing being disposed around the vertically extending central axis relative to the support and the housing being rotatable relative to the vertically extending central axis;

a gear attached to the housing, a pinion gear attached to a shaft of the turning motor; and a roller chain engaging the gears so that rotation of the turning motor causes the base to rotate relative to the support to rotate the cutting unit relative to the support.

6. An apparatus in accordance with claim 1 wherein:

the cutting wheel is inclined inward relative to the vertically extending center axis.

7. An apparatus in accordance with claim 1 wherein:

an underside of the support for a friction coating engaging a smooth upper surface of the coating.

* * * * *